US005232799A

United States Patent [19]

Osawa et al.

[11] Patent Number: 5,232,799

[45] Date of Patent: Aug. 3, 1993

[54] ORGANIC PHOTOSENSITIVE MEMBER COMPRISING A BINDER RESIN AND A SOLVENT

[75] Inventors: Izumi Osawa, Ikeda; Shuji Iino, Hirakata; Isao Doi, Toyonaka; Kenji Masaki, Ibaraki, all of Japan

[73] Assignee: Minolta Camera Kabushiki Kaisha, Osaka, Japan

[21] Appl. No.: 652,504

[22] Filed: Feb. 8, 1991

[30] Foreign Application Priority Data

Feb. 9, 1990 [JP] Japan ..... 2-30208

[51] Int. Cl.[5] ..... G03G 5/14

[52] U.S. Cl. ..... 430/58; 430/60; 430/66

[58] Field of Search ..... 430/58, 60, 66

[56] References Cited

U.S. PATENT DOCUMENTS

| | | | |
|---|---|---|---|
| 4,755,444 | 7/1988 | Karakida et al. | 430/66 |
| 4,882,256 | 11/1989 | Osawa | 430/66 |
| 4,886,724 | 12/1989 | Masaki et al. | 430/66 |
| 4,906,544 | 3/1990 | Osawa et al. | 430/58 |
| 4,939,056 | 7/1990 | Hotomi et al. | 430/66 |

*Primary Examiner*—Marion E. McCamish
*Assistant Examiner*—S. Rosasco
*Attorney, Agent, or Firm*—Burns, Doane, Swecker & Mathis

[57] ABSTRACT

This invention relates to a photosensitive member comprising a conductive substrate; an organic photosensitive layer formed on the conductive substrate, and containing a solvent at a content of 1,500 ppm or less; and a surface protective layer formed on the organic photosensitive layer, which is composed of an amorphous hydrocarbon having an absorptivity coefficient of 400 to 5,000 $cm^{-1}$ with respect to light of 450 nm wavelength.

8 Claims, 2 Drawing Sheets

ORGANIC PHOTOSENSITIVE MEMBER COMPRISING A BINDER RESIN AND A SOLVENT

BACKGROUND OF THE INVENTION

The present invention relates to a photosensitive member, and more particularly, to an organic photosensitive member having a surface protective layer thereon.

Recently prevailing are organic photosensitive members composed of an organic photoconductive material dispersed in a binding resin, since they are more hygienically handled, and more suited for commercial production than those made of selenium, cadmium sulfide, or the like.

The organic photosensitive members are, however, low in hardness, and therefore, are easily abraded and flawed due to the friction with transfer paper, cleaning members, and a developer during their repeated workings.

To eliminate these problems, there is proposed a surface protective layer with a high hardness formed on the surface of an organic photosensitive member.

For example, amorphous hydrocarbon is a well known material for such a surface protective layer featured by high hardness as shown in Japanese Patent Unexamined Publication Nos. Sho 63-97962, Hei 1-4754, and Hei 1-86158 which disclose techniques of forming a surface protective layer of amorphous hydrocarbon on the surface of an organic photosensitive member.

It is to be noted that an amorphous hydrocarbon layer simply formed on the surface of an organic photosensitive member is inclined to cause numerous wrinkles thereover. As a result, the surface of the layer is not smooth but roughened, which results in failure in the cleaning of the photosensitive member.

The present invention is intended to overcome the above discussed problems, and to improve the conventional photosensitive member comprising a surface protective layer of amorphous hydrocarbon formed on an organic photosensitive layer.

SUMMARY OF THE INVENTION

The object of the present invention is to provide an organic photosensitive member with excellent static characteristics by eliminating problems caused by a roughened surface of the protective layer of amorphous hydrocarbon on the organic photosensitive layer.

The present invention relates to a photosensitive member comprising a conductive substrate; an organic photosensitive layer formed on the conductive substrate, and containing a solvent at a content of 1,500 ppm or less; and a surface protective layer formed on the organic photosensitive layer, which is composed of an amorphous hydrocarbon having an absorptivity coefficient of 400 to 5,000 $cm^{-1}$ with respect to light of 450 nm wavelength.

This and other objects, features and advantages of the invention will become more apparent upon a reading of the following detailed specification and drawings.

DETAILED DESCRIPTION OF THE INVENTION

Figure 1:
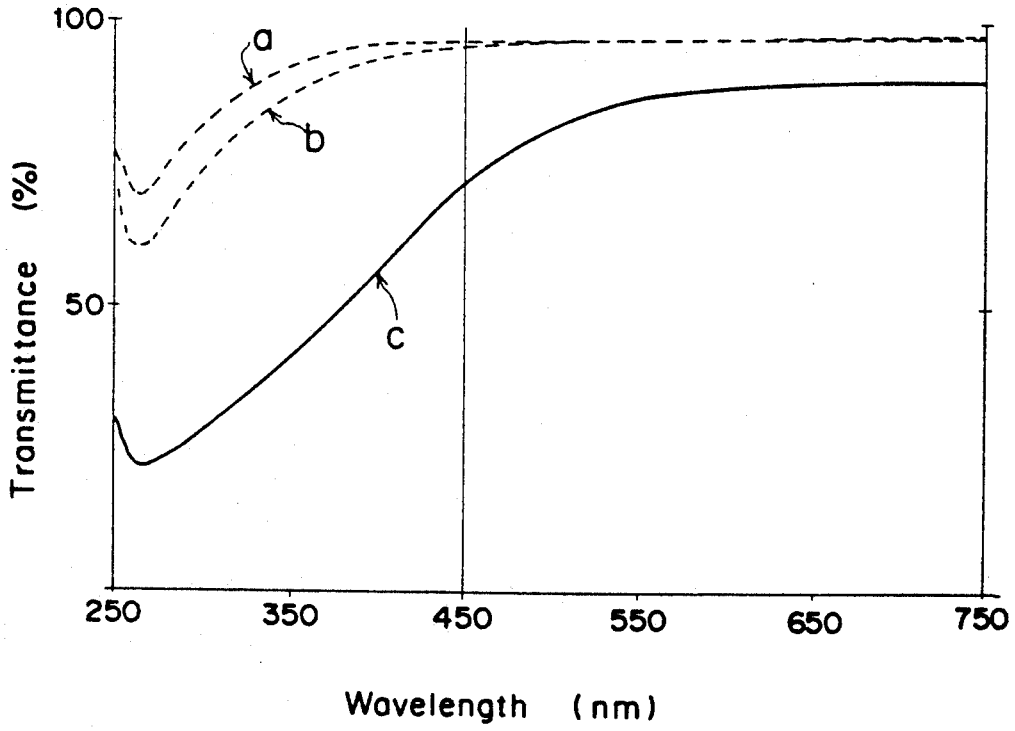
FIG. 1 is a graph showing the typical spectra of visible light passing through amorphous hydrocarbon layers.

The present invention provides a photosensitive member excellent in stability of electrostatic properties even after repeated use.

The present invention has accomplished the above object by specifying a content of a solvent in a photosensitive layer and an absorptivity coefficient of a surface protective layer. The present invention relates to a photosensitive member comprising a conductive substrate; an organic photosensitive layer formed on the conductive substrate, and containing a solvent at a content of 1,500 ppm or less; and a surface protective layer formed on the organic photosensitive layer, which is composed of an amorphous hydrocarbon layer having an absorptivity coefficient of 450 to 5,000 $cm^{-1}$ with respect to light of 450 nm wavelength.

An amorphous hydrocarbon layer has a very high internal stress, while an underlying organic photosensitive layer is not as hard, so that the amorphous hydrocarbon layer relaxes the stress and is hence shrunk to form wrinkles, thereby roughening its surface. The problem caused by the surface roughness can be almost solved by adjusting the solvent content of the organic photosensitive layer to 1,500 ppm or less during a manufacturing process of the same. This also enables manufacturing conditions of the amorphous hydrocarbon layer to be determined within wider ranges.

Generally, in manufacturing organic photosensitive layers, an organic photosensitive material is dissolved or dispersed in a solution of a resin in a solvent, and the obtained solution or dispersion is applied to a conductive substrate, and dried to obtain an organic photosensitive layer. It has been suggested that the organic photosensitive layer has a somewhat porous structure, because the solvent is exuded from the layer to form pores therein during the step of drying the organic photosensitive layer. Therefore, when the solvent content is as small as 1,500 ppm or less, the organic photosensitive layer has numerous pores. The numerous pores bring about another problem. Namely, when a photosensitive member comprising such an organic photosensitive layer and an amorphous hydrocarbon layer thereon is employed in a copying machine or the like, the residual potential of the photosensitive member is disadvantageously raised during the repeated copying operations.

The above-mentioned recognition has led to the following suggestion: the amorphous hydrocarbon layer has a porous structure resulting from its manufacturing method, and hence, has many dangling bonds to easily adsorb ozone, NOx or other active gases, so that the active gases adsorbed into the amorphous hydrocarbon layer may enter the organic photosensitive layer through the pores thereof, and deteriorate a charge-transporting material or a charge-generating material (i.e., deterioration in carrier mobility of the charge-transporting material or in quantum efficiency of the charge-generating material), thereby raising residual potential.

Based on this suggestion, the present inventors further studied the characteristics of the amorphous hydrocarbon layer, and found that its characteristics were notably varied depending on its absorptivity coefficient with respect to light of 450 nm wavelength (hereinafter referred to as $\alpha_{450nm}$), and that when $\alpha_{450nm}$ is set within the range of 400 to 5,000 ($cm^{-1}$), the rise in residual potential as mentioned above can be eliminated.

As described above, the amorphous hydrocarbon layer has a porous structure, and its pores are considered to have a close relationship with the absorptivity coefficient ($\alpha_{450nm}$) of the amorphous hydrocarbon layer. In the case of an amorphous hydrocarbon layer abundant with hollow pores, the absorptivity coefficient is increased since light is scattered in the hollow pores, or since the dangling bonds which appear from the hollow pores absorb light. On the contrary, an amorphous hydrocarbon layer having a low absorptivity coefficient has a small number of hollow pores. Accordingly, by adjusting the $\alpha_{450nm}$ to 400 to 5,000 ($cm^{-1}$), the number of hollow pores in the amorphous hydrocarbon layer may be decreased, and the active gases may be prevented from entering the organic photosensitive layer. Thus, the rise in residual potential of an organic photosensitive member caused when copying operations are repeatedly carried out may be eliminated. In addition, since an amorphous hydrocarbon layer showing an absorptivity coefficient of as low as 400 to 5,000 ($cm^{-1}$) is also low in internal stress, the problem brought about by a roughened surface of the amorphous hydrocarbon layer, which is caused, by the relaxation of the internal stress in the course of the manufacturing process, is completely overcome.

In the present invention, a known organic photosensitive layer may be used.

In structure, the organic photosensitive layer may be a monolayer type photosensitive layer containing a photoconductive material dispersed in a binder, a photosensitive layer having a charge-generating layer and a charge-transporting layer laminated in this order or in reverse order.

The solvent content of the organic photosensitive layer is adjusted to 100 to 1,500 ppm. If it is less than 100 ppm, the adhesivity of an amorphous hydrocarbon layer to the photosensitive layer is poor. If it is greater than 1,500 ppm, the surface of the amorphous hydrocarbon layer is apt to be roughened during its forming process.

The conductive substrate of the present invention may be known so far as at least the uppermost surface thereof can exhibit conductivity, and may be optionally shaped, for example, cylindrically, into a flexible belt, a flat plate or the like.

The surface protective layer of the present invention is formed of amorphous hydrocarbon, and its absorptivity coefficient $\alpha_{450nm}$ is limited to 400 to 5,000 $cm^{-1}$, preferably, to 1,000 to 4,000 $cm^{-1}$. If it is greater than 5,000 $cm^{-1}$, the rise in residual potential caused by repeated operations can not be sufficiently improved. If it is less than 400 $cm^{-1}$, the amorphous hydrocarbon layer will become low in hardness, resulting in poor durability.

The surface protective layer is 0.01 to 5 μm, preferably, 0.04 to 1 μm, and more preferably 0.08 to 0.5 μm in thickness. If its thickness is less than 0.01 μm, the layer strength is lowered, which will cause flaws and cracks in the layer. If it is more than 5 μm, there arise problems such as decrease of sensitivity because of poor light transmittance, increase of residual potential, deterioration of layer forming properties, deterioration of adhesivity, and the like.

In the present invention, it is preferred that a visible light transmittance of the surface protective layer is 80% or more.

In the equation of $I=I_0\exp(-\alpha d)$, to adjust 'I' to 80% or more of $I_0$, the following requirement must be satisfied:

$$\alpha d \leqq 0.223.$$

The amorphous hydrocarbon layer shows the highest absorptivity to light of 450 nm wavelength within the range of 450 to 780 nm wavelength which is generally used to irradiate a photosensitive member in a copying machine. Therefore, it is preferable that the following relationship between the absorptivity coefficient and the thickness of the surface protective layer is satisfied.

$$\alpha_{450nm} \times d \leqq 2230$$

[in which $\alpha_{450nm}$ is the absorptivity coefficient ($cm^{-1}$) with respect to the light of 450 nm wavelength, and d is the thickness (μm) of the surface protective layer.]

Preferably, the maximum height (Rmax) of the roughened surface of the surface protective layer is 0.4 μm or less. If it is greater than 0.4 μm, failure in the cleaning function for the photosensitive member often arises.

The amount of hydrogen atoms contained in the amorphous hydrocarbon layer is not particularly limitative, but is inevitably limited to about 5 to 60 atomic % in terms of the structure of the surface protective layer and the manufacturing technique using glow discharge.

The respective amounts of the carbon atoms and the hydrogen atoms contained in the amorphous hydrocarbon layer can be measured by means of the organic element analysis, Auger analysis, SIMS analysis or the like.

The surface protective layer of the present invention is formed utilizing a glow discharge decomposition technique: voltage is raised in gas-phase molecules containing at least carbon atoms and hydrogen atoms to cause a discharge phenomenon under a vacuum pressure, and active, neutral species, or charged species contained in the generated plasma atmosphere are diffused, and introduced to the substrate by electric force or magnetic force, and deposited as a solid phase on the substrate through the recombination reaction. Briefly, the amorphous hydrocarbon layer is formed through what is called plasma chemical vapor deposition.

The above mentioned molecules are not always of gas-phase at an ordinary temperature under an ordinary pressure, but may be any one of liquid-phase or of solid-phase so far as they can be finally volatilized through a fused, vaporized, or sublimated state.

The molecules containing at least carbon atoms and hydrogen atoms are hydrocarbons such as saturated hydrocarbon, unsaturated hydrocarbon, cycloaliphatic hydrocarbon, aromatic hydrocarbon and the like.

The absorptivity coefficient of the amorphous hydrocarbon layer can be controlled in accordance with the conditions of the layer forming process, such as pressure, discharge frequency, electric power, material gas, gas flow amount and the like.

The amorphous hydrocarbon layer formed by decomposing material gases with high energy has many dangling bonds therein, so that its absorptivity coefficient is increased.

To decrease the absorptivity coefficient of the amorphous hydrocarbon layer, the supplied energy per molecule for decomposition is lessened, and energy necessary only for forming a layer is supplied to each molecule so as not to cause unnecessary dangling bonds. It is to be noted that the supplied energy should not be excessively decreased. The reason is that when the supplied energy is too low, the bond strength between each of the molecules required for forming an amorphous hydrocarbon layer becomes insufficient, resulting in poor hardness and low abrasion resistance.

Accordingly, the absorptivity coefficient of the amorphous hydrocarbon layer can be properly controlled by other various methods, such as by increasing pressure, by decreasing electric power, by increasing gas flow amount, by employing a hydrocarbon having many carbon atoms as a material gas, by increasing discharge frequency, by lowering the substrate temperature, by shortening the discharge time or the like. These controlling methods can be used singly or in combination so that $\alpha_{450nm}$ of the amorphous hydrocarbon layer can be adjusted to 400 to 5,000 $cm^{-1}$.

Specifically, in the present invention, by preparing an amorphous hydrocarbon layer under the conditions satisfying the following expression [I], the amorphous hydrocarbon having $\alpha_{450nm}$ of 400 to 5,000 $cm^{-1}$ can be efficiently obtained.

$$0.005 \leqq A \leqq 0.15 \quad [I]$$

in which

A: Pwr/(FR·Prs)

Pwr: supplied electric power [W]

FR: amount of introduced material gas [sccm]

Prs: pressure [Torr]

In the expression [I], if A is less than 0.005, the hardness of the obtained amorphous hydrocarbon layer is low, resulting in poor durability. If it is greater than 0.15, the absorptivity coefficient of the obtained amorphous hydrocarbon layer is apt to be large.

The following examples are included merely to aid in the understanding of the invention, and variation may be made by one skilled in the art without departing from the spirit and scope of the invention.

Formation of photosensitive layer

Formation of organic photosensitive layer (a)

A liquid mixture of 1 part by weight of bisazo pigment of chlorodian blue (CDB), 1 part by weight of polyester resin (V-200; made by TOYOBO K.K.), and 100 parts by weight of cyclohexanone was dispersed for 13 hours by means of a sand grinder. A cylindrical aluminum substrate (80 mm diameter×330 mm length) was dipped in this dispersion to be coated therewith, and dried so that a charge-generating layer of 0.3 μm thickness was formed on the substrate.

In the meantime, 1 part by weight of 4-diethylaminobenzaldehyde-diphenylhydrazone (DEH) and 1 part by weight of polycarbonate (K-1300; made by Teijin Kasei K.K.) were dissolved in 6 parts by weight of tetrahydrofuran (THF). The obtained solution was applied to the charge-generating layer, and dried at 100° C. for 45 minutes so that a charge-transporting layer of 15 μm thickness was formed. Thus, an organic photosensitive layer (a) was obtained.

The solvent content of the organic photosensitive layer (a) was 1,520 ppm.

To determine the solvent content, the residual solvent was extracted from the photosensitive layer, and analyzed by means of gas chromatography to determine the solvent content. More particularly, a part of the photosensitive layer was precisely measured, and immersed in a solvent such as acetone, methyl ethyl ketone, tetrahydrofuran, ethanol or the like. Then, the residual solvent in the photosensitive layer was extracted by the help of ultrasonic vibration or the like. An internal standard substance such as benzene, toluene, xylene, hexane, or the like was added to the extract, and the obtained mixture was determined by gas chromatography in accordance with the internal standard method.

Formation of organic photosensitive layer (b)

Two parts by weight of bisazo compound represented by the following formula Ia, 1 part by weight of a polyester resin (V-500; made by TOYOBO K.K.), and 100 parts by weight of methyl ethyl ketone were stirred for 24 hours to disperse the same in a ball mill. Then, a cylindrical aluminum substrate (80 mm diameter×330 mm length) was dipped in this dispersion to be coated therewith, and dried so that a charge-generating layer of 3,000 Å thickness was formed.

[Ia]

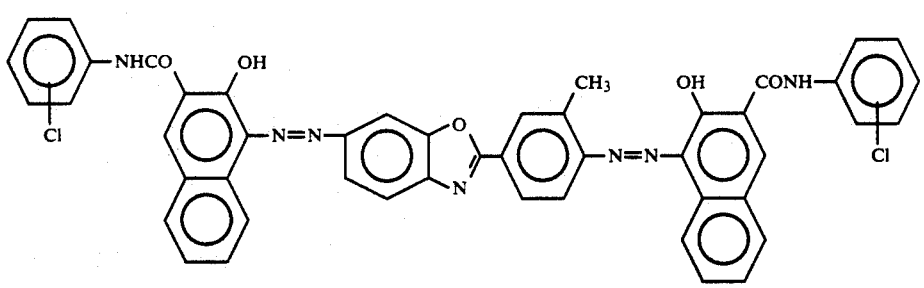

Then, 10 parts by weight of hydrazone compound represented by the following formula Ib and 10 parts by weight of a polycarbonate resin (K-1300; made by Teijin Kasei K.K.) were dissolved in 80 parts by weight of tetrahydrofuran. The obtained solution was applied to the above mentioned charge-generating layer, and dried at 80° C. for one hour so that a charge-transporting layer of 20 μm thickness was formed. Thus, an organic photosensitive layer (b) was obtained.

[Ib]

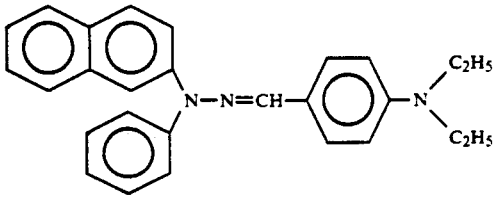

The solvent content of the organic photosensitive layer (b) was 1,900 ppm.

Formation of organic photosensitive layer (c)

Two parts by weight of a bisazo compound represented by the following formula IIa, 1 part by weight of a polyester resin (V-500; made by TOYOBO K.K.), and 100 parts by weight of methyl ethyl ketone were stirred for 24 hours to disperse the same in a ball mill. Then, a cylindrical aluminum substrate (80 mm diameter×330 mm length) was dipped in this dispersion to be coated therewith, and dried so that a charge-generating layer of 2,500 Å thickness was formed.

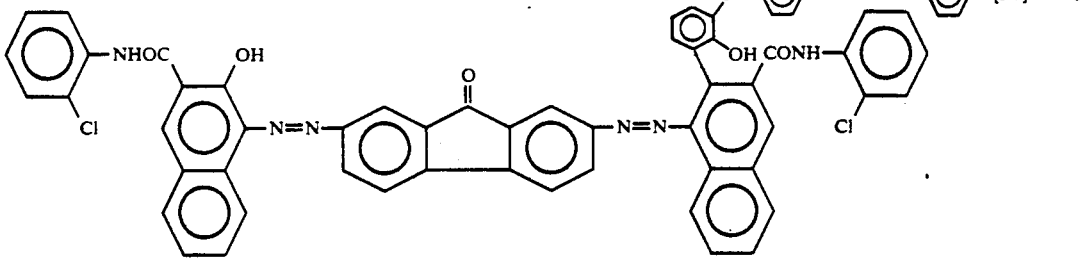

Then, 10 parts by weight of styryl compound represented by the following formula IIb, and 10 parts by weight of a polyarylate resin (U-4000; made by Yunitika K.K.) were dissolved in 85 parts by weight of tetrahydrofuran. The obtained solution was applied to the above mentioned charge-generating layer, and dried at 80° C. for 30 minutes so that a charge-transporting layer of 20 μm thickness was formed. Thus, an organic photosensitive layer (c) was obtained.

[IIb]

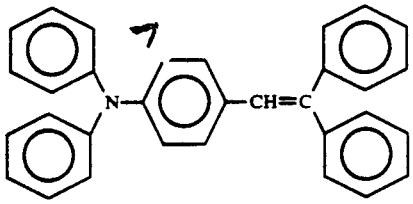

The solvent content of the organic photosensitive layer was 2,120 ppm.

Formation of organic photosensitive layer (d)

Two parts by weight of bisazo compound represented by the following formula IIIa, 1 part by weight of a polyester resin (V-500; made by TOYOBO K.K.), and 100 parts by weight of methyl ethyl ketone were stirred for 24 hours to disperse the same in a ball mill. Then, a cylindrical aluminum substrate (80 mm diameter×330 mm length) was dipped in this dispersion to be coated therewith, and dried so that a charge-generating layer of 3,000 Å thickness was formed.

[IIIa]

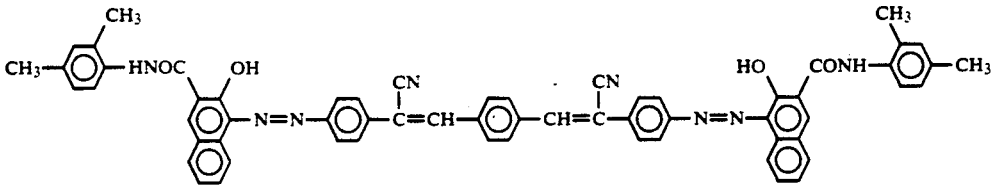

Then, 10 parts by weight of a styryl compound represented by the following formula IIIb, and 10 parts by weight of methyl methacrylate resin (BR-85; made by Mitsubishi Rayon K.K.) were dissolved in 80 parts by weight of tetrahydrofuran. The obtained solution was applied to the above mentioned charge-generating layer, and dried at 70° C. for 30 minutes so that a charge-transporting layer of 20 μm thickness was formed. Thus, an organic photosensitive layer (d) was obtained.

[IIIb]

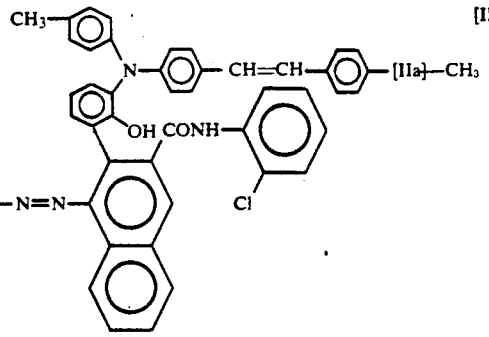

The solvent content of the organic photosensitive layer was 2,380 ppm.

Formation of organic photosensitive layer (e)

Titanyl phthalocyanine (TiOPc) was deposited at a boat temperature of 400 to 500° C. under the atmosphere of a vacuum degree of $10^{-4}$ to $10^{-6}$ Torr according to a resistive heating method so that a TiOPc deposited layer of 2,500 Å thickness was formed as a charge-generating layer.

Then, 1 part by weight of p,p-bisdiethylaminotetraphenylbutadien represented by the following formula IV and 1 part by weight of polycarbonate (K-1300; made by Teijin Kasei K.K.) were dissolved in 6 parts by weight of THF. The obtained solution was applied to the above mentioned charge-generating layer, and dried at 100° C. for 30 minutes so that a charge-transporting layer of 15 μm thickness was formed. Thus, an organic photosensitive layer (e) was obtained.

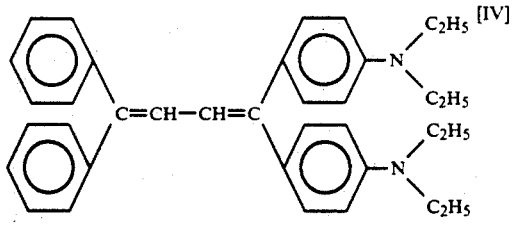

[IV]

The solvent content of the organic photosensitive layer (e) was 1,670 ppm.

In this connection, among these organic photosensitive layers (a) to (e), the photosensitive layer (e) is used for the exposure to light of a long wavelength, and the remaining are used for normal exposure.

Formation of Surface Protective Layer

Example 1

The organic photosensitive layer (a) having a solvent content of 1,520 ppm was set in the vacuum tank of the apparatus shown in the Japanese Patent Unexamined Publication No. Sho 63-97962.

The vacuum tank was evacuated, and maintained at 0.005 Torr, and left stand for 12 hours. For this period, the temperature of the organic photosensitive layer was kept at 50° C.

The content of residual solvent contained in the organic photosensitive layer was 1,000 ppm after being left stand for 12 hours.

Then, 600 sccm of hydrogen gas and 600 sccm of butadiene gas were introduced into the vacuum tank to adjust the internal pressure to 2 Torr.

When the pressure in the tank was stabilized, an electric power of 50 W was supplied from a power source of 80 KHz frequency.

The above defined A value (refer to the expression [1]) was 0.0208, and the temperature of the photosensitive layer was 50° C.

Layer forming process was carried out for 230 seconds, so that a photosensitive member having an amorphous hydrocarbon layer of 0.1 μm thickness as a surface protective layer was obtained.

The $\alpha_{450nm}$ was 2,000 [1/cm], and the value of $d \cdot \alpha_{450nm}$ was 200.

The maximum height (Rmax.) of the photosensitive member was 0.04 μm.

The residual potential of the photosensitive member was measured to obtain 20 V. Furthermore, the pencil hardness thereof was 9H.

The absorptivity coefficient $\alpha_{450nm}$ was measured as follows: the amorphous hydrocarbon layer was prepared on a transparent glass substrate (for example, #7059; made by Corning K.K.), and a spectrum of transmitted visible light was measured by a visible ultraviolet photometer (for example, UVIDEC-610 type; made by Nippon Bunkokogyo K.K.).

FIG. 1 is a graph showing the typical spectra of transmitted visible light, in which the curves (a) and (b) (with respect to the amorphous hydrocarbon layers (a) and (b)) are high in transmittance, namely, low in absorptivity coefficient $\alpha_{450nm}$ with respect to light of 450 nm wavelength, and in which the curve (c) (with respect to the amorphous hydrocarbon layer (c)) is high in absorptivity coefficient $\alpha_{450nm}$.

The glass substrate was partially masked to have a non-coated area, and the difference in thickness between the coated area and the non-coated area was measured with a roughness measuring apparatus (for example, Surfcom 550A; made by Tokyo Seimitsu K.K.).

Then, the value of α was calculated according to the following equation.

$$\alpha\lambda = -(1/D)\cdot\log_e(I\lambda/I_o\lambda)$$

(in which αλ is the absorptivity coefficient with respect to light of a wavelength λ, D is the layer thickness, and $I\lambda/I_o\lambda$ is the transmittance with respect to the light of the wavelength λ).

The reason why α was evaluated with respect to the light of 450 nm is that photosensitive members are used usually within a specific visual sensitivity range (450 to 650 nm), or within a range sensitive to a light-emitting diode or semiconductor laser (680 to 780 nm). Therefore, amorphous hydrocarbon layers are required to transmit the light at least within such ranges. It is no use to evaluate the transmitting characteristics of a light other than the above specified light. Accordingly, the light of 450 nm which was the most convenient to evaluate variations in wavelength was selected from the above specified wavelength ranges.

The maximum height Rmax was measured by a roughness measuring apparatus (Surfcom 550A; made by Tokyo Seimitsu K.K.).

Figure 2:
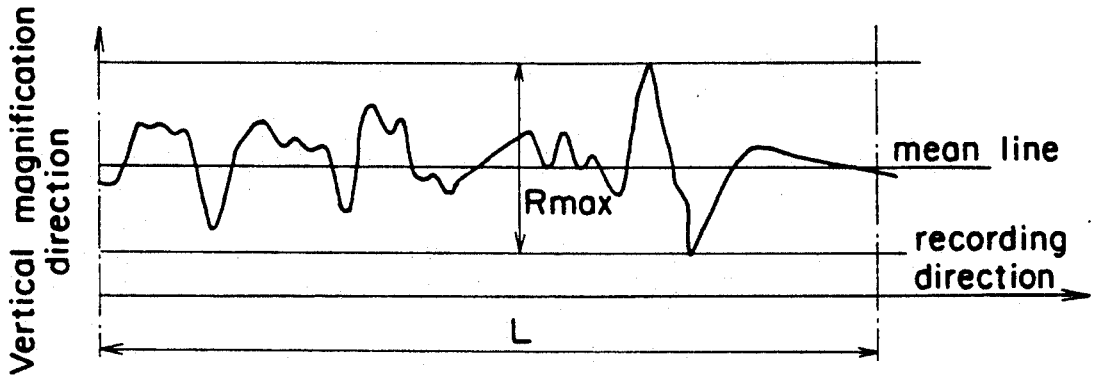
FIG. 2 illustrates a method of measuring a maximum height of a surface roughness of an amorphous hydrocarbon layer.

The maximum height Rmax was measured as follows: referring to FIG. 2, the roughness curve was cut out by a reference length (L:0.25 mm), and a pair of parallel lines respectively passing through the top and the bottom of the cut curve were drawn, and the distance between each of the parallel lines was measured in the vertical magnification direction of the cut curve. The obtained value was expressed with micrometer(μm).

In this connection, the maximum height was preferably 0.4 μm or less from the viewpoint of practical use, since if it was higher than 0.4 μm, failure was often caused in cleaning the photosensitive member.

Figure 3:
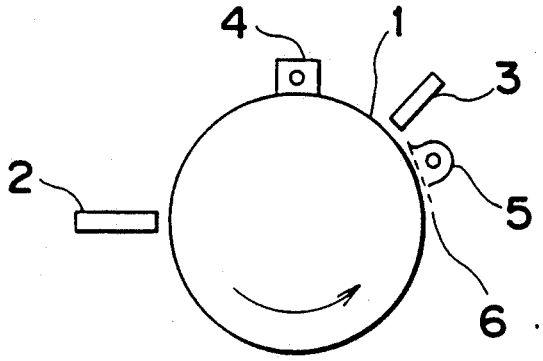
FIG. 3 is a schematic constitutional view of a tester for measuring the residual potential of a photosensitive member.

The residual potential was evaluated by such a tester as shown in FIG. 3. A power of charger (4) was adjusted so that the monitor value sensed by a first surface potentiometer (2) could be constantly kept at −500±20 V.

A halogen lamp was used as a static eliminating lamp (5), and it was turned on at a color temperature of 2,800° K. to irradiate a photosensitive member (1) through a filter (6) so that the photosensitive member (1) could be exposed to a light amount of 30 [lux sec.], with the exception that the static eliminating lamp (5) was turned on at a color temperature of 2,200° K. in the case of the photosensitive member (e).

The photosensitive member (1) was formed cylindrically (ϕ80 mm×1330 mm), and was revolved at a circumferential speed of 13 cm/sec. in operation.

The residual potential was evaluated based on the monitor value sensed by a second surface potentiometer (3). The evaluation was made with symbols o, Δ, and x, based on the difference between the residual potential (Vr') measured after 5,000 times of revolution of the photosensitive member (1) and the residual potential (Vr) after the first revolution of the same.

o: $|Vr' - Vr| \leqq 50$

Δ: $50 < |Vr' - Vr| \leqq 100$ x: $100 < |Vr' - Vr|$

Furthermore, the surface hardness of the photosensitive member was measured as follows: an amorphous hydrocarbon layer, the thickness of which was 1,000 Å, was provided on a glass substrate, and the layer hardness was tested on the basis of the pencil scratching test: JIS-K-5400 standards. The evaluation was made as follows:

Pencil hardness o: 6H or more

Δ: H to 5H x: F or less

Examples 2 to 16 and Comparative Examples 1 to 6 shown in Table 1 were produced in the same manner as that of Example 1, with the exception that the producing conditions of the respective organic photosensitive layers and the respective surface protective layers were determined as shown in Table 1. In addition, the respective photosensitive members were evaluated in the same manner as those of Example 1.

What is claimed is:

1. A photosensitive member comprising a conductive substrate; an organic photosensitive layer formed on the conductive substrate, and comprising an organic charge-generating material, an organic charge-transporting material, a binder resin and a solvent at a content of from 100 to 1,500 ppm; and a surface protective layer formed on the organic photosensitive layer, which is composed of an amorphous hydrocarbon having an absorptivity coefficient of 400 to 5,000 $cm^{-1}$ with respect of light of 450 nm wavelength.

2. A photosensitive member as claimed in claim 1, wherein said surface protective layer is composed of an amorphous hydrocarbon having an absorptivity coefficient of 1,000 to 4,000 $cm^{-1}$ with respect to light of 450 nm wavelength.

3. A photosensitive member as claimed in claim 1, wherein said surface protective layer is 0.01 to 5 μm in thickness.

TABLE 1

| | Organic photosensitive layer (solvent content ppm) | Solvent-reducing treatment | Residual solvent (ppm) | Material gases gas (sccm) | Material gases gas (sccm) | Total flow amount (sccm) |
|---|---|---|---|---|---|---|
| Com. Ex. 1 | (a) (1520) | left stand in a vacuum | 1000 | hydrogen 1000 | butadiene 800 | 1800 |
| Ex. 2 | " | tank (0.005 Torr) for | " | hydrogen 800 | butadiene 800 | 1600 |
| Ex. 3 | " | 12 hours. The temp. | " | hydrogen 800 | butadiene 600 | 1400 |
| Ex. 4 | " | of the photosensitive | " | hydrogen 600 | butadiene 600 | 1200 |
| Ex. 1 | " | layer was 50° C. | " | hydrogen 600 | butadiene 600 | 1200 |
| Ex. 5 | " | | " | hydrogen 400 | butadiene 300 | 700 |
| Ex. 6 | " | | " | hydrogen 400 | butadiene 150 | 550 |
| Ex. 7 | " | | " | hydrogen 350 | butadiene 50 | 400 |
| Com. Ex. 2 | " | | " | hydrogen 300 | butadiene 50 | 350 |
| Com. Ex. 3 | (a) (1520) | in the same manner as | 200 | | the same as Com. Ex. 1 | |
| Ex. 8 | " | that of the above | " | | the same as Ex. 2 | |
| Ex. 9 | " | mentioned except for | " | | the same as Ex. 4 | |
| Ex. 10 | " | the time of 36 hours. | " | | the same as Ex. 6 | |
| Ex. 11 | " | | " | | the same as Ex. 7 | |
| Com. Ex. 4 | " | | " | | the same as Com. Ex. 2 | |
| Ex. 12 | (a) (1520) | the same as mentioned above | 200 | argon 800 | propylene 300 | 1100 |
| Ex. 13 | (b) (1900) | in the same manner as | 810 | hydrogen 800 | propane 400 | 1200 |
| Ex. 14 | (c) (2120) | that of the above | 900 | hydrogen 800 | acetylene 600 | 1400 |
| Ex. 15 | (d) (2380) | mentioned except for | 1000 | hydrogen 900 | propylene 400 | 1300 |
| Ex. 16 | (e) (1670) | the time of 12 hours. | 690 | helium 700 | butadiene 300 | 1000 |
| Com. Ex. 5 | (d) (2380) | non-treatment | 2380 | hydrogen 300 | butadiene 50 | 350 |
| Com. Ex. 6 | (c) (2120) | non-treatment | 2120 | hydrogen 300 | butadiene 50 | 350 |

| | Power (W) | Pressure (Torr) | (A) value | Freq. (Hz) | Ts (°C.) | layer forming time (sec.) | layer thickness d (μm) | Coefficient α450 (1 cm) | d × α450 | Surface roughness R max. | Residual potential | Pencil hardness |
|---|---|---|---|---|---|---|---|---|---|---|---|---|
| Com. Ex. 1 | 40 | 5 | 0.0044 | 80K | 50 | 180 | 0.1 | 350 | 35 | 0.02 | o | x |
| Ex. 2 | 40 | 5 | 0.005 | 80K | 50 | 190 | 0.1 | 400 | 40 | 0.02 | o | Δ |
| Ex. 3 | 50 | 4 | 0.0089 | 80K | 50 | 200 | 0.1 | 600 | 60 | 0.03 | o | Δ |
| Ex. 4 | 50 | 3 | 0.0139 | 80K | 50 | 210 | 0.1 | 1000 | 100 | 0.03 | o | o |
| Ex. 1 | 50 | 2 | 0.0208 | 80K | 50 | 230 | 0.1 | 2000 | 200 | 0.04 | o | o |
| Ex. 5 | 50 | 2 | 0.0357 | 80K | 50 | 240 | 0.1 | 3000 | 300 | 0.05 | o | o |
| Ex. 6 | 60 | 1 | 0.1091 | 80K | 50 | 260 | 0.1 | 4000 | 400 | 0.06 | o | o |
| Ex. 7 | 60 | 1 | 0.15 | 80K | 50 | 280 | 0.1 | 5000 | 500 | 0.08 | Δ | o |
| Com. Ex. 2 | 70 | 1 | 0.2 | 80K | 50 | 300 | 0.1 | 6000 | 600 | 0.1 | x | o |
| Com. Ex. 3 | | | | the same as Com. Ex. 1 | | | | | | 0.02 | o | x |
| Ex. 8 | | | | the same as Ex. 2 | | | | | | 0.02 | o | Δ |
| Ex. 9 | | | | the same as Ex. 4 | | | | | | 0.02 | o | o |
| Ex. 10 | | | | the same as Ex. 6 | | | | | | 0.03 | o | o |
| Ex. 11 | | | | the same as Ex. 7 | | | | | | 0.05 | Δ | o |
| Com. Ex. 4 | | | | the same as Com. Ex. 2 | | | | | | 0.08 | x | o |
| Ex. 12 | 100 | 1 | 0.0909 | 80K | 70 | 500 | 0.2 | 3800 | 760 | 0.08 | o | o |
| Ex. 13 | 100 | 1.4 | 0.0595 | 80K | 30 | 1150 | 0.75 | 2200 | 1100 | 0.08 | o | o |
| Ex. 14 | 50 | 1.6 | 0.0223 | 200K | 50 | 220 | 0.1 | 2200 | 220 | 0.03 | o | o |
| Ex. 15 | 40 | 1.8 | 0.0171 | * | 50 | 420 | 0.2 | 1300 | 260 | 0.04 | o | o |
| Ex. 16 | 30 | 2 | 0.015 | 80K | 30 | 200 | 0.1 | 1100 | 110 | 0.02 | o | o |
| Com. Ex. 5 | 70 | 0.8 | 0.25 | 80K | 50 | 320 | 0.1 | 10000 | 1000 | 0.5 | o | o |
| Com. Ex. 6 | 70 | 0.7 | 0.286 | 80K | 50 | 340 | 0.1 | 15000 | 1500 | 1.1 | o | o |

Remarks: Ts . . . the temperature of the organic photosensitive layer

* . . . 13.56M

4. A photosensitive member as claimed in claim 3, wherein said surface protective layer is 0.04 to 1 μm in thickness.

5. A photosensitive member as claimed in claim 1, wherein the absorptivity coefficient $\alpha(cm^{-1})$ with respect to light of 450 nm, and the thickness d (μm) of the surface protective layer have a relationship satisfying the following formula:

$$\alpha \times d \leqq 2230.$$

6. A photosensitive member as claimed in claim 1, wherein the surface roughness of said surface protective layer is 0.4 μm or less in maximum height Rmax.

7. A photosensitive member comprising a conductive substrate; an organic photosensitive layer formed on the conductive substrate, which comprises an organic charge-generating material, an organic charge-transporting material, a binder resin and a solvent at a content of from 100 to 1,500 ppm; and a surface protective layer formed on the organic photosensitive layer, which is composed of an amorphous hydrocarbon produced in accordance with a plasma chemical vapor deposition method (plasma CVD) under conditions satisfying the following relation:

$$0.005 \leqq \text{supplied electric power}/(\text{material gas introduction amount} \times \text{pressure}) \leqq 0.15$$

in which the respective units are W for the supplied electric power, sccm for the material gas introduction amount, and Torr for the pressure.

8. A photosensitive member as claimed in claim 7, wherein said surface protective layer is composed of an amorphous hydrocarbon having an absorptivity coefficient of 1,000 to 4,000 $cm^{-1}$ with respect to light of 450 nm wavelength.

* * * * *